United States Patent [19]

Bushyhead et al.

[11] Patent Number: 4,613,047

[45] Date of Patent: Sep. 23, 1986

[54] SMALL ARTICLE DISPLAY ASSEMBLY

[75] Inventors: Jess C. Bushyhead, Kansas City; Harvey L. Kolster, Grain Valley; Michael G. Lowry, Holt, all of Mo.; Fred C. Wolf, Overland Park, Kans.

[73] Assignee: Hallmark Cards, Incorporated, Kansas City, Mo.

[21] Appl. No.: 715,531

[22] Filed: Mar. 25, 1985

[51] Int. Cl.[4] ..... A47F 7/00

[52] U.S. Cl. ..... 211/55; 211/128; 108/101

[58] Field of Search ..... 211/55, 128; 108/97, 108/101

[56] References Cited

U.S. PATENT DOCUMENTS

| | | | |
|---|---|---|---|
| 490,156 | 1/1893 | Miller | 211/55 X |
| 2,283,546 | 5/1942 | Fischer | 211/55 |
| 2,869,732 | 1/1959 | Ganz | 211/55 |
| 3,198,340 | 8/1965 | Tokash | 211/55 X |
| 4,162,014 | 7/1979 | Bobrick | 211/55 X |

FOREIGN PATENT DOCUMENTS

| | | | |
|---|---|---|---|
| 1482997 | 8/1977 | United Kingdom | 211/55 |

*Primary Examiner*—J. Franklin Foss
*Assistant Examiner*—Blair Johnson
*Attorney, Agent, or Firm*—Neuman, Williams, Anderson & Olson

[57] ABSTRACT

A display assembly for displaying and storing articles such as greeting cards. The assembly involves a support structure for supporting one or more individual display units with each of the display units having a storage compartment and a display compartment. Means are provided on the display units whereby one display unit can be joined to another display unit.

8 Claims, 6 Drawing Figures

FIG. 1
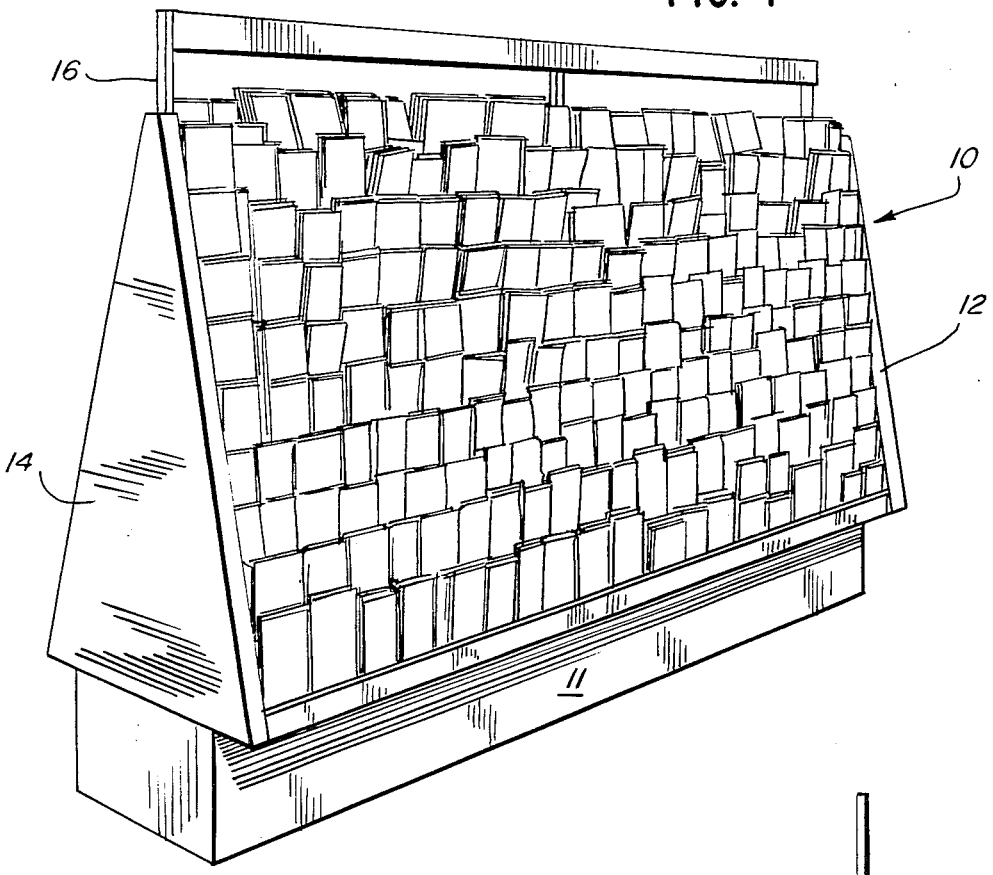
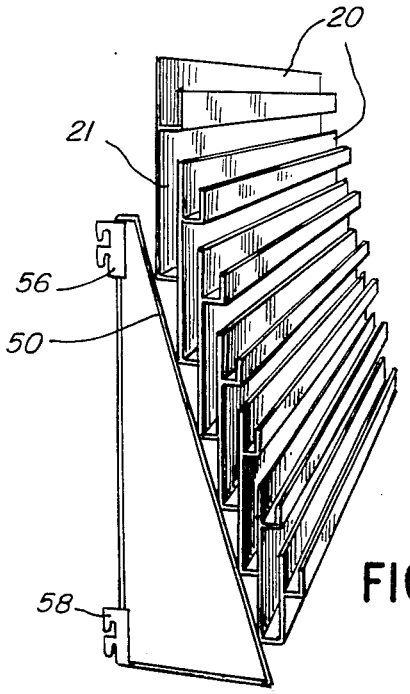
FIG. 2
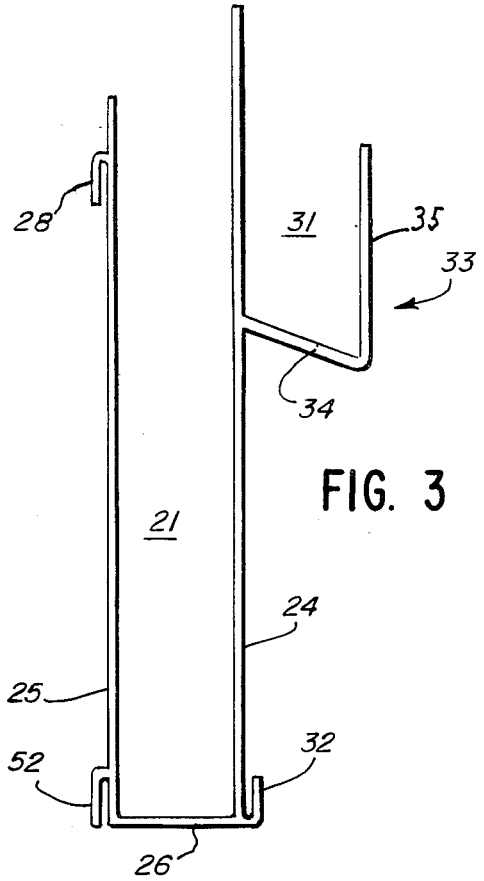
FIG. 3

FIG. 4
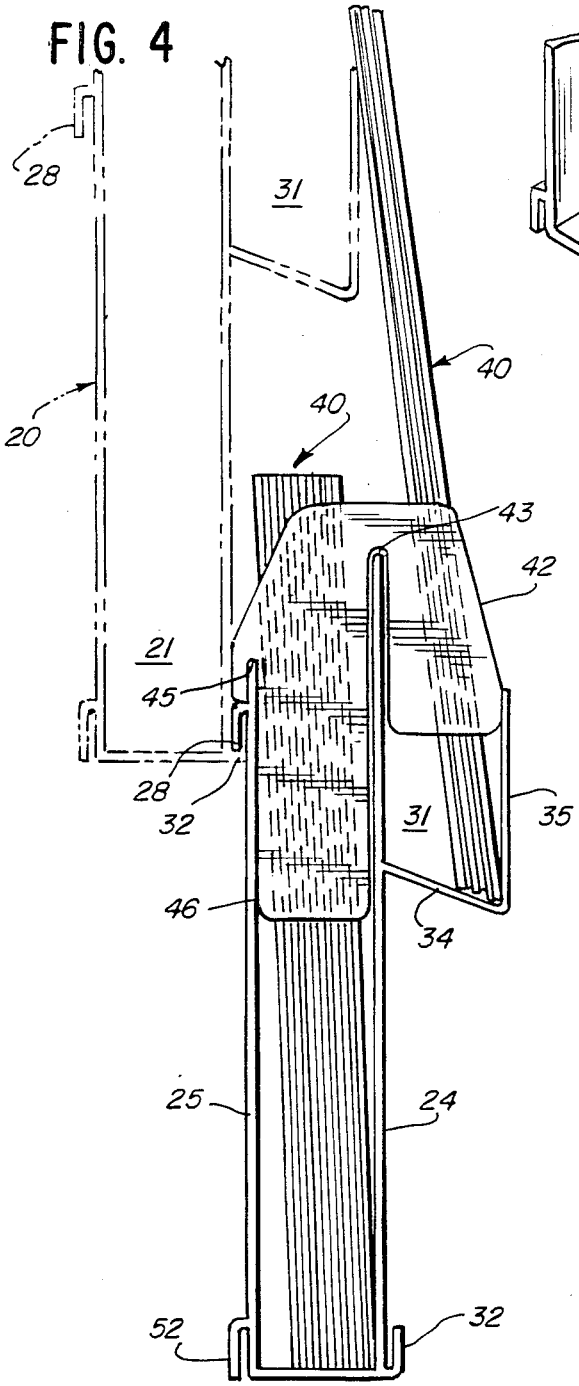
FIG. 6
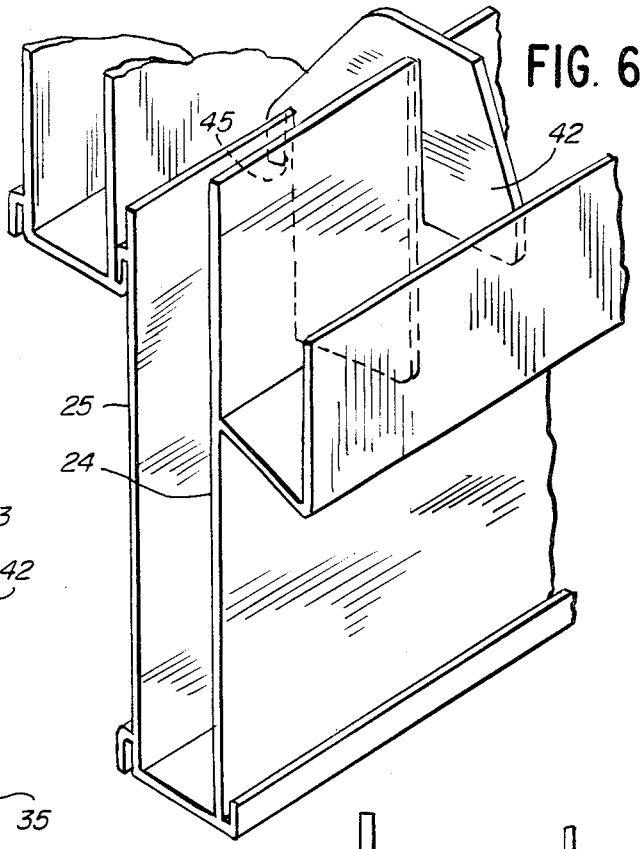
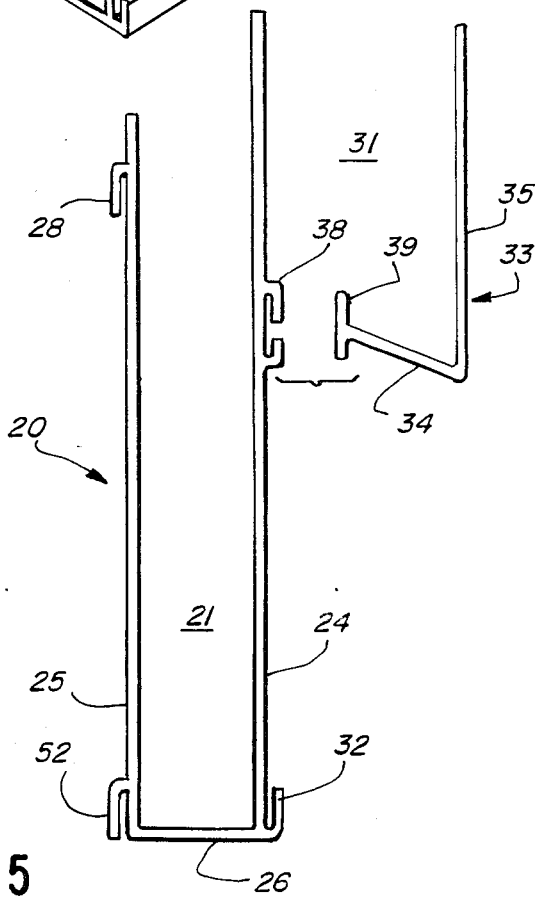
FIG. 5

SMALL ARTICLE DISPLAY ASSEMBLY

This invention relates to merchandise display and more particularly to a display assembly for use in displaying cards, pamphlets, bulletins and the like.

A principal object of the invention is to provide a display assembly of such construction that it can be quickly and easily assembled to display articles such as greeting cards.

Another object of the invention is to provide a display assembly which is light in weight and which can be readily attached to a support structure for displaying cards and the like in such manner that the cards are readily visible and can be easily removed therefrom.

A still further object of the invention is to provide a display assembly involving individual display units which can be easily engaged with and disengaged from one another to provide a display assembly of desired size.

A still further object of the invention is to provide an attractive, lightweight display assembly for displaying cards and the like which contains means for storing therein inventory or reserve stock of the displayed articles.

Other objects and advantages of the invention will be apparent from the following description taken in conjunction with the accompanying drawings wherein:

FIG. 1 is an elevational perspective view of a display embodying the display assembly of the invention showing a number of greeting cards disposed therein as illustrative of articles which can be displayed.

FIG. 2 is a perspective view showing a plurality of display and storage units in interengaged relationship so as to form the display assembly.

FIG. 3 is a side elevational view of one display and storage unit.

FIG. 4 is a side elevational view of two display and storage units in engaged position.

FIG. 5 is a side elevational view of another embodiment of the display and storage unit shown in FIG. 3.

FIG. 6 is a fragmentary perspective view showing a preferred form of card divider for use with the display and storage units.

This invention involves a display assembly for displaying and storing articles such as greeting cards and the like. The assembly involves a support structure for supporting one or more individual display units. Each of the display units has a horizontally extending generally U-shaped storage compartment defined by spaced vertically extending rear and front walls joined by a horizontal bottom wall. A horizontally extending generally U-shaped display compartment projects forwardly from the upper portion of said storage compartment and is defined by a vertically extending forward wall, a bottom wall and the front wall of the storage compartment. Both the storage and display compartments are adapted to receive articles to be displayed. An outwardly extending flange or clip member of inverted U-shape is provided on the outer surface near the top edge of the rear vertical wall defining the storage compartment and a mating outwardly extending flange or clip member of U-shape is provided near the lower edge of the front wall defining the storage compartment. These flange members serve a clipping function and are adapted for interlocking engagement with one another whereby one display unit can be joined to another display unit.

Referring now to the drawings in greater detail, the display 10 is adapted to serve as a point of sales for cards, pamphlets, bulletins and the like. The display 10 as illustrated in FIG. 1 comprises a free standing support structure 11 comprised of side walls 12 and 14 and a back panel 16 to provide an open front display housing. The support structure 11 is shown as a free standing housing, but it should be appreciated that the support structure 11 can take various forms and need be only a wall or a framework to which the display and storage units can be secured, such as illustrated in FIG. 2. Disposed within the support structure 11 are a plurality of individual storage and display units 20 which involve a horizontally extending storage compartment 21 which in side elevational view has a generally U-shaped configuration defined by the spaced parallel vertically extending front wall 24 and back wall 25 connected by the bottom wall 26. The height of the front wall 24 is preferably greater than the height of back wall 25. Both of the walls 24 and 25 can be of an appropriate desired dimension depending on the size of the articles to be stored, for example, for use with greeting cards the walls can be approximately 12 and 8 inches respectively. Similarly, the dimension of bottom wall 26 depends upon the number of articles to be stored therein and can, for example, be 2–3 inches. The longitudinal or horizontal dimension of the storage compartment 21 can be varied as necessary to provide a display of any desired size or width.

Disposed on the outer surface near or at the upper edge of rear wall 25 is an outwardly projecting flange or clip member 28 having an inverted U-shaped configuration. Disposed on the outer surface near or at the lower edge of front wall 24 is an outwardly projecting flange or clip element 32 having a U-shaped configuration. The flange elements 28 and 32 are adapted for mating engagement with one another whereby one display unit can be joined to another.

A horizontally extending, generally U-shaped display compartment 31 projects outwardly from the upper portion of the front wall 24 of storage compartment 21 of the display unit 20. The display compartment 31 is formed by an angled arm 33 having a base portion 34 which projects outwardly from wall 24 and an upstanding vertical portion 35. The display compartment 31 is preferably dimensioned so as to hold the articles to be displayed while permitting good visual observation of the article. The display compartment 31 is smaller in vertical dimension than the storage compartment 21 and is positioned forwardly thereof and in a plane in the upper portion of the storage compartment. With this construction, cards or the like in the display compartment are highly visible and can be easily removed therefrom while at the same time concealing reserve stock in storage compartment 21.

The display unit 20, consisting of storage compartment 21 and display compartment 31, is preferably formed of thin, light-weight, rigid materials such as metals or plastics, e.g. acrylic plastics. The display unit 20 can be produced in one piece by suitable extrusion or molding techniques (FIG. 3). Alternatively, the storage compartment 21 and display component 31 can be formed as separate elements, as illustrated in FIG. 5. In accordance with this embodiment, C-shaped hook flange 38 is provided on the front wall 24 of the storage compartment 21 and a T-shaped lip 39 is provided at the end of arm 33. Lip 39 is adapted to be received in hook flange 38 in tongue-in-groove relationship to secure together storage compartment 21 and display compartment 31. An advantage of this embodiment is that the elements of arm 33 can be formed of clear or transparent materials to provide visibility of the displayed articles while the remainder of the unit 20 can be formed of opaque materials.

In use, a plurality of display units 20 are joined together as illustrated in FIG. 4 by engaging the downwardly extending inverted U-shaped flange or clip 28 on one display unit into the upwardly extending U-shaped flange or clip 32 on a second display unit. In this manner any desired number of display units can be joined one to another, thus affording flexibility as to the overall size of the display. The articles to be displayed, such as greeting cards 40, are placed in display section 31 from which they can be observed and readily removed. Reserve stock of the greeting cards are stored in storage section 21 of the display unit. When the display units are joined together in overlapping step-like fashion (FIG. 2) the inventory or reserve stock of the greeting cards is not visible, yet the reserve stock can be easily obtained and placed in the display section 31. Storage of the reserve stock in this manner is advantageous in that it eliminates the need for separate and detached storage space such as merchandise drawers or boxes. Also, by having the reserve stock stored in the display rack itself, the problems of inventory recording, etc. are simplified.

A card divider element 42 can be slidably engaged on the wall 24 of the display unit to separate the articles to be displayed. In one preferred form, the divider is provided with a vertically extending centrally disposed slot 43 which is adapted for slidable engagement over the upper portion of the wall 24. A smaller vertically extending slot 45 is provided at the top of the rear edge of the divider element for slidable engagement over the upper portion of the wall 25. The card divider enhances the structural strength of the unit and can be formed of any suitable lightweight material such as an extruded or molded plastic.

As indicated, the support structure for the display assembly can take various forms and can be of simple construction. For example, one simple framework which serves as the essential support structure involves triangularly shaped frame 50 for use on each side of the display (one frame only being shown in FIG. 2). The frames 50 have spaced inwardly projecting lugs which are received in the flange member 52 of the display unit. The frame is preferably provided with hook members 56 and 58 whereby the frame can be attached to a support such as a wall.

Those modifications and equivalents which fall within the spirit of the invention are to be considered a part thereof.

What is claimed is:

1. A display unit for displaying and storing articles comprising a horizontally extending, generally U-shaped storage compartment defined by spaced, vertically extending rear and front walls joined by a horizontal bottom wall, the vertical extent of said front wall being at least as great as that of said rear wall, and a horizontally extending generally U-shaped display compartment being defined by a vertically extending forward wall, a bottom wall and the front wall of the storage compartment, the said display compartment being fixedly attached to the upper portion of the vertically extending front wall of said storage compartment, the vertical extent of said display compartment being substantially less than that of said storage compartment, whereby articles stored in said storage compartment are concealed from frontal view when articles are displayed in said display compartment, both the storage and display compartments being adapted to receive articles to be displayed and the front and rear walls of said storage compartment having on the exterior surfaces thereof U-shaped and inverted U-shaped, respectively, flange members whereby one display unit can be joined to another display unit.

2. A display unit in accordance with claim 1 having an outwardly extending clip member of inverted U-shape on the exterior surface of the vertically extending rear wall defining said storage compartment and an outwardly extending clip member of U-shape on the vertically extending front wall of said storage compartment, the said clip members being adapted for interlocking engagement whereby one display unit can be joined to another.

3. A display unit in accordance with claim 1 wherein the storage compartment and display compartment are of one-piece construction.

4. A display unit in accordance with claim 1 wherein the storage compartment and display compartment are detachable.

5. A display unit in accordance with claim 1 wherein the said display compartment is formed of a transparent material.

6. A display unit in accordance with claim 1 which includes a slidable divider element for separating articles in said storage and display compartments.

7. A display assembly for displaying and storing articles comprising:

a support structure and one or more individual display units supported by said support structure, each of said display units comprising a horizontally extending, generally U-shaped storage compartment defined by spaced vertically extending rear and front walls joined by a horizontal bottom wall, the vertical extent of the front wall being at least as great as that of said rear wall, and a horizontally extending generally U-shaped display compartment being defined by a vertically extending forward wall, a bottom wall and the front wall of the storage compartment, the said display compartment being fixedly attached to the upper portion of the vertically extending front wall of said storage compartment, the vertical extent of said display compartment being substantially less than that of said storage compartment, whereby articles stored in said storage compartment are concealed from frontal view when articles are displayed in said display compartment, both the storage and display compartments being adapted to receive articles to be displayed, an outwardly extending clip member of inverted U-shape on the exterior surface of the rear vertically extending wall of said storage compartment and an outwardly extending clip member of U-shape on the front vertically extending wall of said storage compartment, the said clip members being adapted for interlocking engagement whereby one display unit can be joined to another.

8. A display assembly in accordance with claim 24 having a plurality of said display units joined together in an overlapping step-like fashion.

* * * * *

UNITED STATES PATENT AND TRADEMARK OFFICE

CERTIFICATE OF CORRECTION

PATENT NO. : 4,613,047

DATED : September 23, 1986

INVENTOR(S) : Jess C. Bushyhead, Harvey L. Kolster, Michael G. Lowry and Fred C. Wolf It is certified that error appears in the above-identified patent and that said Letters Patent is hereby corrected as shown below:

Column 4, line 65, "claim 24" should be -- claim 7 --

Signed and Sealed this

Sixteenth Day of December, 1986

*Attest:*

DONALD J. QUIGG

*Attesting Officer* *Commissioner of Patents and Trademarks*